US007766703B2

(12) United States Patent
Carver

(10) Patent No.: US 7,766,703 B2
(45) Date of Patent: Aug. 3, 2010

(54) ELECTRICAL CONNECTOR WITH ROTATABLE FASTENER

(75) Inventor: Keith R. Carver, Alameda, CA (US)

(73) Assignee: Cableco Technologies Corporation, San Jose, CA (US)

( * ) Notice: Subject to any disclaimer, the term of this patent is extended or adjusted under 35 U.S.C. 154(b) by 834 days.

(21) Appl. No.: 10/767,177

(22) Filed: Jan. 30, 2004

(65) Prior Publication Data

US 2005/0170705 A1 Aug. 4, 2005

(51) Int. Cl.
*H01R 4/38* (2006.01)

(52) U.S. Cl. ..... 439/801

(58) Field of Classification Search ..... 439/801, 439/810, 813, 445–447; 411/999, 969, 533; 403/342, 362

See application file for complete search history.

(56) References Cited

U.S. PATENT DOCUMENTS

| | | | | |
|---|---|---|---|---|
| 1,026,035 | A | | 5/1912 | Hedden |
| 1,039,542 | A | | 9/1912 | Kennington |
| 1,416,881 | A | | 7/1915 | Jeffries |
| 1,871,839 | A | | 8/1932 | Carter |
| 1,872,616 | A | | 8/1932 | Andren |
| 2,075,675 | A | | 3/1937 | Thorrez |
| 2,246,901 | A | | 6/1941 | Schwarzmann |
| 2,414,143 | A | | 1/1947 | Dunning |
| 2,930,836 | A | | 3/1960 | Floyd |
| 2,931,009 | A | | 3/1960 | Dutton |
| 2,959,764 | A | | 11/1960 | Barr |
| 3,192,980 | A | | 7/1965 | Sauter |
| 3,209,806 | A | | 10/1965 | Currier |
| 3,365,998 | A | | 1/1968 | Zahodiakin |
| 3,474,399 | A | | 10/1969 | Teagno |
| 3,653,294 | A | | 4/1972 | Nason |
| 3,775,730 | A | * | 11/1973 | Rowls et al. ..... 439/521 |
| 3,899,238 | A | | 8/1975 | Vinje |
| 3,957,331 | A | | 5/1976 | Tantillo et al. |
| 4,003,616 | A | | 1/1977 | Springer |
| 4,046,054 | A | | 9/1977 | Gulistan |
| 4,555,832 | A | | 12/1985 | Sano |
| 4,717,299 | A | | 1/1988 | Underwood |
| 4,905,122 | A | | 2/1990 | Culnan |
| 4,941,789 | A | | 7/1990 | Sims |
| 4,986,712 | A | | 1/1991 | Fultz |
| 4,990,106 | A | | 2/1991 | Szegda |
| 5,006,025 | A | | 4/1991 | Duran |
| 5,470,257 | A | | 11/1995 | Szegda |
| 5,597,279 | A | | 1/1997 | Thomas |
| 5,611,654 | A | | 3/1997 | Frattarola |

(Continued)

*Primary Examiner*—Felix O Figueroa
(74) *Attorney, Agent, or Firm*—Roylance, Abrams, Berdo & Goodman, L.L.P.

(57) ABSTRACT

An electrical connector to mechanically and electrically connecting first and second electrical conduit assemblies. The first electrical conduit assembly has a first conductive contact and an aperture in the first conductive contact. A first fastener is rotatably received in the aperture. The first fastener has a head member and a body portion. A threaded passageway extends from the head member to a distal end of the body portion. The distal end of the body portion is swaged to prevent the first fastener from being accidentally removed from the aperture. A second electrical conduit assembly has a second conductive contact. A second fastener extends outwardly from the second conductive contact and is adapted to be threadably received by the passageway of the first fastener.

28 Claims, 4 Drawing Sheets

U.S. PATENT DOCUMENTS

| | | | | |
|---|---|---|---|---|
| 5,655,936 | A | 8/1997 | Meredith | |
| 5,791,919 | A | 8/1998 | Brisson | |
| 5,842,894 | A | 12/1998 | Mehlberg | |
| 5,871,402 | A | 2/1999 | Bachle | |
| 5,941,654 | A | 8/1999 | Chauquet | |
| 5,975,821 | A * | 11/1999 | Kue | 411/533 |
| 6,220,801 | B1 | 4/2001 | Lin | |
| 6,280,263 | B1 | 8/2001 | Manor | |
| 6,343,962 | B2 * | 2/2002 | Krause | 439/801 |
| 6,343,963 | B1 | 2/2002 | Bronk | |
| 6,866,456 | B2 * | 3/2005 | Bentrim | 411/353 |

* cited by examiner

ELECTRICAL CONNECTOR WITH ROTATABLE FASTENER

FIELD OF THE INVENTION

The present invention relates to an electrical and mechanical connection between first and second electrical conduit assemblies. More particularly, the present invention relates to an electrical and mechanical connection between first and second electrical conduit assemblies that does not require movement of either conduit assembly to provide a secure connection therebetween. Still more particularly, the present invention relates to a connector for connecting first and second electrical conduit assemblies in which a rotatable fastener is swaged to the first conduit assembly to allow easy and cost-effective manufacture and assembly and to prevent accidental removal of the fastener.

BACKGROUND OF THE INVENTION

Electrical systems often require electrical and mechanical coupling of cable, or conduit, assemblies. Cables are typically terminated by electrically and mechanically connecting the terminated cables with a cable lug having a contact plate. The contact plates are then connected to provide an electrical and mechanical coupling between the terminated conduit assemblies.

One problem with existing connections between conduit assemblies is that the mounting hardware is often fixed to the contact plate. The contact plates, including the attached conduit assemblies, must be rotated to complete the connection between the two assemblies since the mounting hardware is rigidly fixed to the contact plate. Thus, a need exists for an electrical and mechanical connection between the conduit assemblies that does not require moving or rotating the contact plates or conduit assemblies to make the connection.

One solution to this problem is to provide hardware that is rotatably secured to the contact plate. However, this creates another problem because, while the mounting hardware is rotatably secured, it is also releasably secured. Connecting two conduit assemblies with releasable mounting hardware requires time and patience. Moreover, if the mounting hardware falls out during the connection process, the hardware could fall into machinery, resulting in electrical and/or mechanical damage to the machine. Furthermore, the installer must carry extra inventory in case parts of the mounting hardware are lost or damaged during the installation process. Thus, a need exists for an electrical and mechanical connection between conduit assemblies having mounting hardware that is rotatably and non-releasably secured.

Another problem with existing mounting hardware for electrically and mechanically connecting conduit assemblies is that the contact plates and mounting hardware are not protected from harsh environment conditions that could over time detrimentally effect and/or degrade the electrical and mechanical connection between the two conduit assemblies. Additionally, such mounting hardware is subject to electrical shorting if the hardware is not properly protected. A need exists for a cover assembly to protect the contact plates and mounting hardware to preserve the electrical and mechanical connection between the conduit assemblies.

Examples of existing mounting hardware having fasteners rotatably and non-releasably received by contact plates are disclosed in U.S. Pat. No. 5,611,654 to Frattarola et al.; U.S. Pat. No. 5,842,894 to Mehlberg; U.S. Pat. No. 6,343,963 B1 to Bronk; and U.S. Pat. No. 6,220,801 to Lin; and U.S. Pat. No. 5,597,279 to Thomas et al. and U.S. Pat. No. 5,871,402 to Bächle disclose swaged fasteners, the disclosure of which are hereby incorporated herein by reference.

Thus, there is a continuing need to provide improved connections between first and second electrical conduit assemblies.

SUMMARY OF THE INVENTION

Accordingly, it is a primary object of the present invention to provide an improved electrical connector for electrically and mechanically connecting first and second electrical conduit assemblies.

A further object of the present invention is to provide an electrical connection between first and second electrical conduit assemblies that does not require movement of either conduit assembly to provide a secure connection therebetween.

Another object of the present invention is to provide improved mounting hardware for connecting first and second conduit assemblies in which a fastener is swaged to allow easy and cost-effective manufacture and assembly and to prevent accidental removal of the fastener from the contact plate.

A still further objective of the present invention is to provide a boot assembly for protecting a conduit assembly from environmental and other detrimental damage, including electrical shorting.

The foregoing objectives are basically attained by an electrical connector, comprising a first electrical conduit assembly having a first conductive contact and an aperture in the first conductive contact; a first fastener rotatably received in the aperture, the first fastener having a head member and a body portion, a threaded passageway extending from the head member to a distal end of the body portion, the distal end of the body portion being swaged to prevent the first fastener from being accidentally removed from the aperture; a second electrical conduit assembly having a second conductive contact; a second fastener extending outwardly from the second conductive contact and adapted to be threadably received by the passageway of the first fastener.

The foregoing objects are also attained by a method of method of electrically and mechanically connecting first and second conduit assemblies; inserting a first fastener in an aperture in the first conduit assembly; swaging a distal end of the first fastener to allow the first fastener to be rotatable within the aperture and to prevent accidental removal of the first fastener from the aperture; inserting a second fastener connected to the second conduit assembly in an internally threaded passageway of the first fastener; and rotating the first fastener to draw the second fastener into the internally threaded passageway of the first fastener without unduly moving the first and second conduit assemblies, thereby creating a secure electrical and mechanical connection between the first and second conduit assemblies.

Other objects, advantages and salient features of the invention will become apparent from the following detailed description, which, taken in conjunction with the annexed drawings, discloses a preferred embodiment of the invention.

BRIEF DESCRIPTION OF THE DRAWINGS

Referring now to the drawings that form a part of the original disclosure.

DETAILED DESCRIPTION OF THE INVENTION

Figure 1:
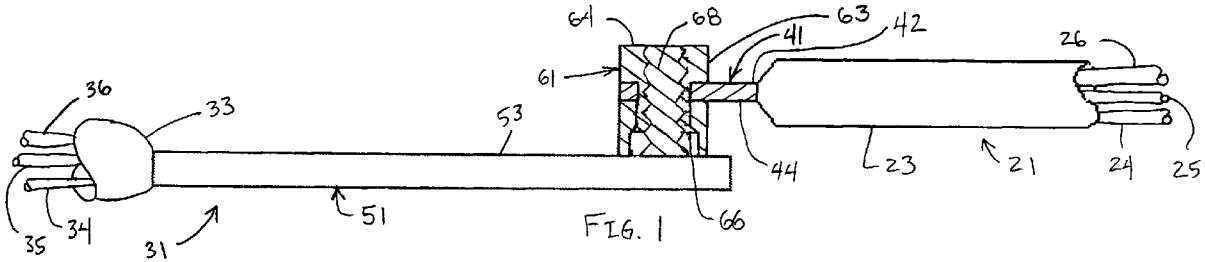
FIG. 1 is a side elevational view in partial cross section of an electrical connector connecting first and second electrical conduit assemblies according to the present invention.
Figure 2:
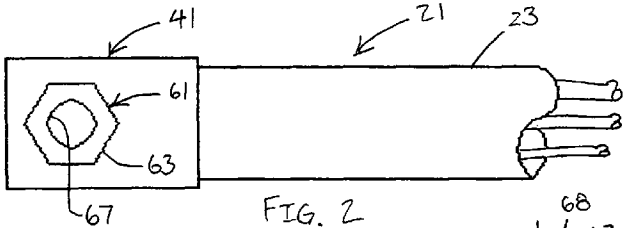
FIG. 2 is a top plan view of a first fastener secured to the first conduit assembly of FIG. 1.
Figure 3:
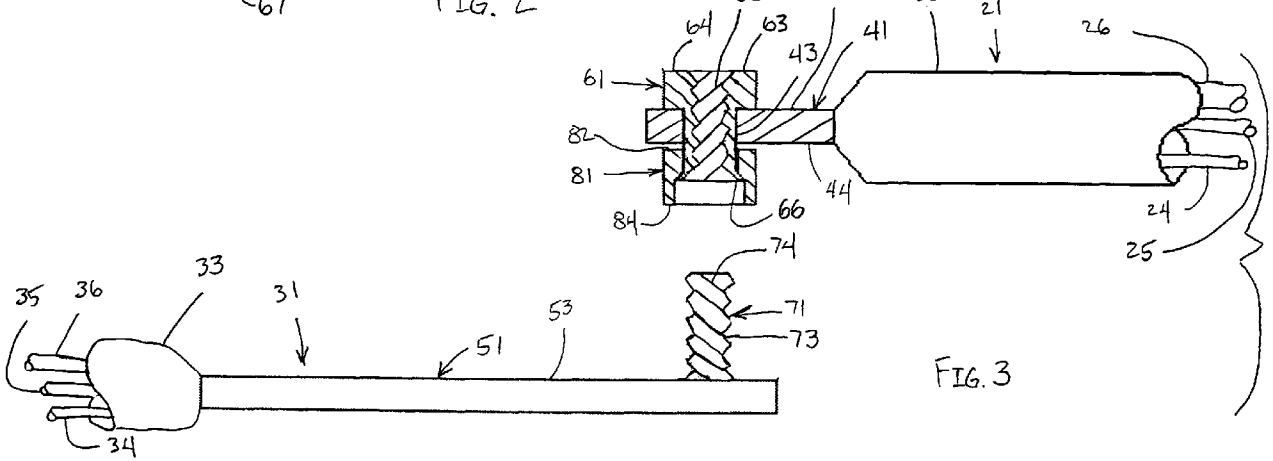
FIG. 3 is an exploded side elevational view in partial cross section of the first fastener and a spacer secured to the first conduit assembly and a second fastener secured to the second conduit assembly of FIG. 1.

As shown in FIGS. 1-12, the present invention relates to an electrical connection between a first electrical conduit assembly 21 and a second electrical conduit assembly 31, as shown in FIGS. 1 and 3, allowing power distribution from one system to another through the connected first and second conduit assemblies. The first conduit assembly 21 has a first conductive contact plate 41 and an aperture 43 in the first conductive contact plate. A first fastener, or conductive securing member, 61 is rotatably received in the aperture 43. The first fastener 61 has a head member, or support section, 63 and a body portion 65. A threaded passageway 67 extends from the head member 63 to a distal end 66 of the body portion 65. The distal end 66 of the body portion 65 is swaged to allow easy and cost-effective manufacture and assembly and to prevent the first fastener 61 from being accidentally removed from the aperture 43. A second conduit assembly 31 has a second conductive contact 51. A second fastener 71 extends outwardly from the second conductive contact 51 and is adapted to be threadably received by the passageway 67 of the first fastener 61.

A first conduit assembly 21 has a plurality of cables 24, 25 and 26 connected to a first conductive contact plate 41, as shown in FIGS. 1-3. The cables 24-26 are terminated and electrically and mechanically connected to the first contact plate 41 by any suitable, conventional method. Any number of cables may be terminated and connected to the first contact plate 41. A protective cover 23 protects the connection between the terminated cables 24-26 and the first contact plate 41.

A second conduit assembly 31 has a plurality of cables 34, 35 and 36 connected to a second conductive contact plate 51, as shown in FIGS. 1 and 3. The cables 34-36 are terminated and electrically and mechanically connected to the second contact plate 51 by any suitable, conventional method. Any number of cables may be terminated and connected to the second contact plate 51. A protective cover 33 protects the connection between the terminated cables 34-36 and the second contact plate 51.

Figure 9:
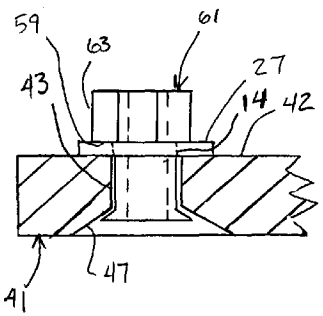
FIG. 9 is a side elevational view in partial cross section of a first fastener swaged to a countersunk contact plate.
Figure 5:
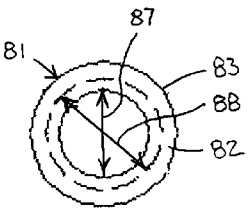
FIG. 5 is a top plan view of the spacer.
Figure 6:
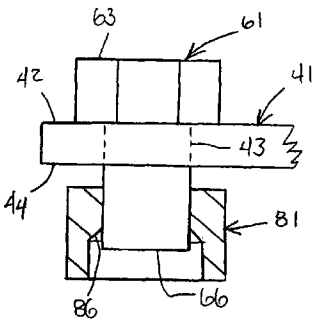
FIG. 6 is a side elevational view in partial cross section showing the first fastener being received by the spacer.
Figure 8:
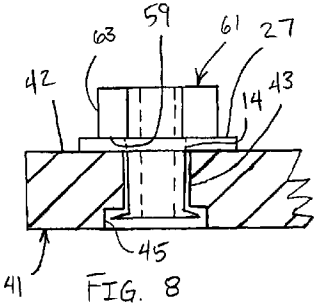
FIG. 8 is a side elevational view in partial cross section of the first fastener swaged to a counterbored contact plate.
Figure 4:
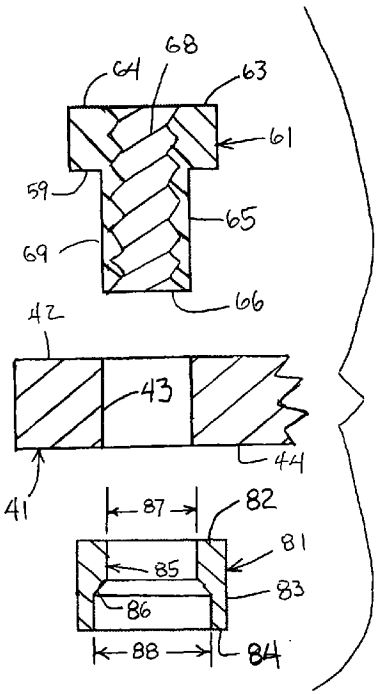
FIG. 4 is an exploded side elevational view in cross section of the first fastener, first contact plate and spacer prior to assembly.

The first conductive contact plate 41 is substantially rectangular, as shown in FIG. 2, but may be of any suitable configuration. The first conductive contact plate 41 extends from the electrical cables 24-26. An aperture 43 in the first contact plate 41 extends between an upper surface 42 and a lower surface 44 of the first contact plate, and is adapted to receive the first fastener 61. As shown in FIG. 8, the aperture 43 may have a counterbore 45 to facilitate securing, or locking, the first fastener 61 to the first contact plate 41. As shown in FIG. 9, the aperture 43 may have a countersink 47 to facilitate securing, or locking, the first fastener 61 to the first contact plate 41.

Figure 13:
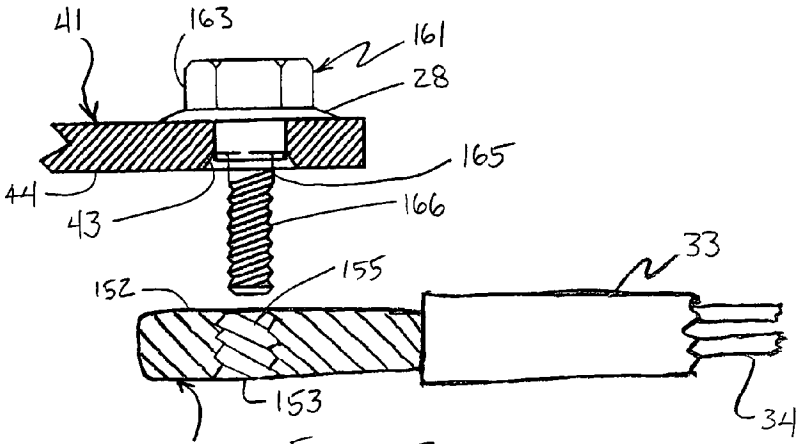
FIG. 13 is a side elevational view of threaded aperture in a second contact plate adapted to receive a first fastener having an externally threaded body portion.
Figure 14:
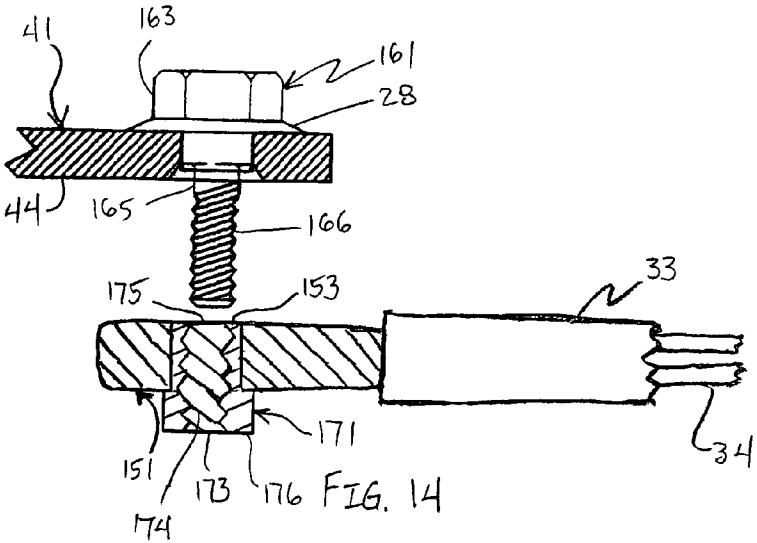
FIG. 14 is a side elevational view of a second contact plate having an internally threaded second fastener adapted to receive a first fastener having an externally threaded body portion.

The second conductive contact plate 51 may be of any suitable configuration, such as the rectangular shape of the first conductive contact plate 41. The second conductive contact plate 51 extends from the electrical cables 34-36, as shown in FIGS. 1 and 3. The second fastener 71 extends outwardly from the second contact plate 51. The second fastener 71 may be secured to the second contact plate 51 by any suitable, conventional method, such as by welding. Preferably, the second fastener 71 is secured to an upper surface 53 of the second contact plate 51. Alternatively, as shown in FIGS. 13 and 14, a second conductive plate 151 may have an aperture 153. Preferably, the aperture 153 has threads 155, as shown in FIG. 13.

The first fastener 61, as shown in FIGS. 1-4 and 6-12, has a head member 63, a body portion 65 extending from the head member and a passageway 67 extending from the head member to a distal end 66 of the body portion 65. Preferably, the head member 63 is a hexagonal nut, as shown in FIG. 2. The head member 63 has an upper surface 64. The passageway 67 preferably extends from the upper surface 64 of the head member 63, through the head member and through the body portion 65 to the distal end 66 of the body portion. The passageway 67 is open at both the head member 63 and the distal end 66 to receive a second fastener 71 of any length therein. Preferably, the passageway 67 has threads 68 to facilitate receiving the second fastener 71 and drawing the second fastener through the passageway. The head member 63 of the first fastener 61 has a width larger than the width of the aperture 43 to support the first fastener on the upper surface 42 of the first contact plate 41, i.e., the larger width of the head member prevents the first fastener from being drawn through the aperture. The body portion 65 has a width less than that of the aperture 43 to allow the body portion to be received within the aperture. Preferably, the outer surface 69 of the body portion 65 is smooth to facilitate rotation of the body portion of the first fastener 61 within the aperture 43. Once the first fastener 61 is received by the first contact plate 61 (and spacer 81, if applicable), the distal end 66 of the first fastener is swaged radially outward to increase its diameter and to secure, or lock, the first fastener to the first contact plate 41 and prevent removal of the first fastener from the first contact plate. Preferably, the first fastener 61 is made of brass. The first fastener 61 may be plated to preserve the fastener against environmental conditions. Any suitable plating material may be used, such as tin, silver, gold or nickel plating.

Figure 15:
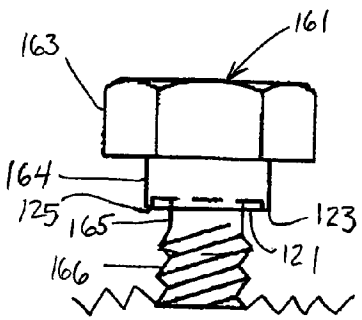
FIG. 15 is a side elevational view of a first fastener in which a portion of the body portion is threaded.

Alternatively, a first fastener 161 has a body portion 165, as shown in FIGS. 13-15. Preferably, a portion 166 of the body portion 165 is threaded. A shoulder 164 is positioned between a head member 163 and the body portion 165. Preferably, the first fastener 161 is made of brass. A cut-out 121 in a lower surface 123 of the shoulder forms a circumferential lip 125 to facilitate swaging the first fastener 161 to the aperture in the first conductive contact plate 41. The first fastener 161 may be plated to preserve the fastener against environmental conditions. Any suitable plating material may be used, such as tin, silver, gold or nickel plating.

The second fastener 71, as shown in FIGS. 1 and 3, extends outwardly from the second contact plate 51. Preferably, the second fastener 71 is a shank having threads 74 on an outer surface 73. As the second fastener 71 is drawn through the passageway 67 of the first fastener 61, the second contact plate 51 is drawn up with the second fastener until the upper surface 53 of the second contact plate substantially abuts the lower surface 44 of the first contact plate 41.

Alternatively, the second fastener 171 may be press fit in the aperture 153 in the second conductive contact plate 151, as shown in FIG. 14. A passageway 173 extends from a distal end 175 to a head member 176 of the second fastener 171. Preferably, the passageway 173 has threads 174 to receive the threaded portion 166 of the first fastener 161.

Figure 7:
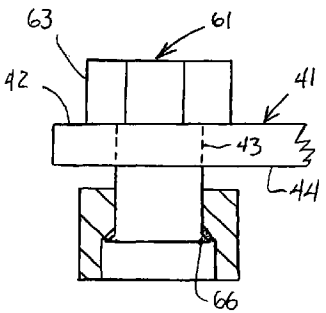
FIG. 7 is a side elevational view in partial cross section showing the first fastener swaged to the spacer.

A spacer 81 having an outer surface 83 may be positioned on the body portion 65 of the first fastener 61 adjacent the lower surface 44 of the first contact plate to provide a separating distance between the first and second contact plates 41 and 51 when the electrical and mechanical connection is made therebetween. The spacer 81, as shown in FIGS. 1, 3 and 4-7, is substantially cylindrical having an opening 85 extending from an upper surface 82 to a lower surface 84. The opening 85 has a first diameter 87 at the upper surface 82 and a second diameter 88 at the lower surface 84 of the spacer 81. The first diameter 87 is smaller than the second diameter 88. A step 86 in the opening 85 increases the diameter the opening from the first diameter to the second diameter. The step 86 in the opening 85 facilitates swaging the distal end 66 of the first fastener 61 to the spacer 81, as shown in FIG. 7. Preferably, the spacer 81 is made of brass.

Figure 10:
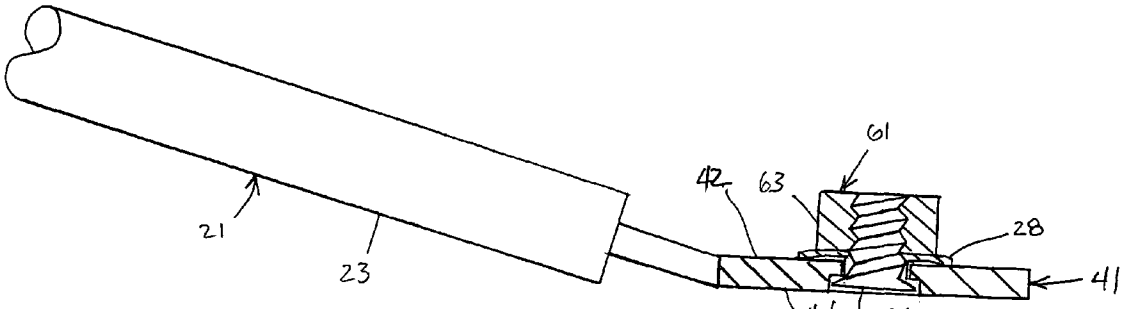
FIG. 10 is a side elevational view of a first fastener swaged to a first contact plate with a washer positioned between a head member of the first fastener and the first contact plate.
Figure 11:
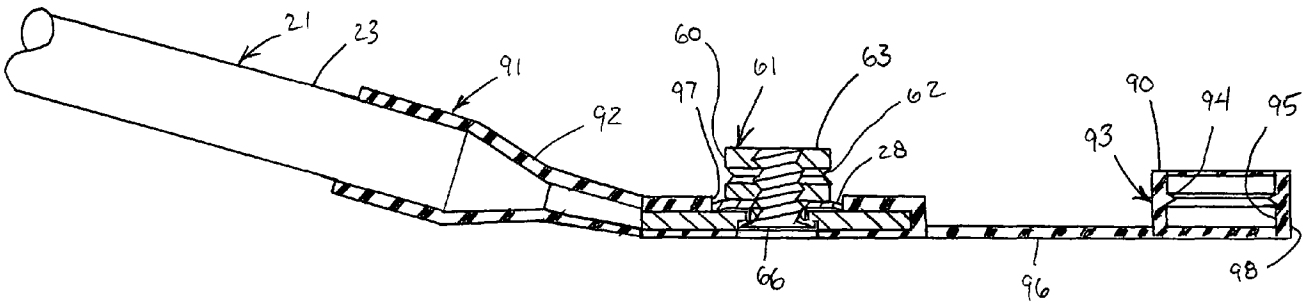
FIG. 11 is a side elevational view of a first fastener swaged to a first contact plate with a washer positioned between a head member of the first fastener and the first contact plate, and a boot assembly secured to the first conduit assembly.
Figure 12:
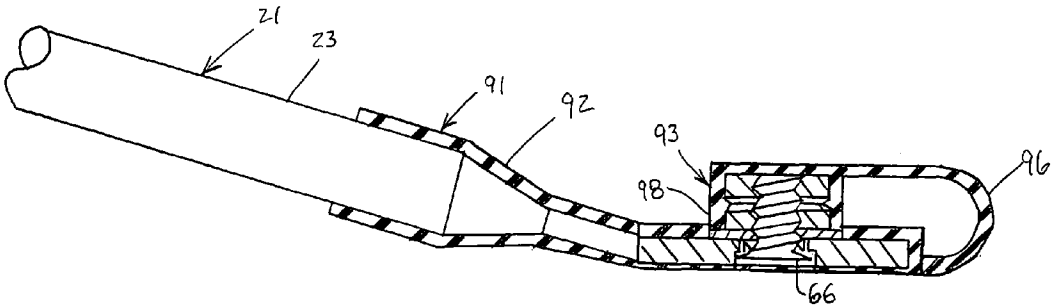
FIG. 12 is a side elevational view of a boot cap of a boot assembly secured to a head member of a first fastener that has been swaged to a first contact plate.

A washer 27 may be positioned between the head member 63 of the first fastener 61 and the upper surface 42 of the first contact plate 41, as shown in FIGS. 8-12. The washer has a central opening 14 to receive the body portion 65 of the first fastener. As shown in FIGS. 8 and 9, a flat washer 27 may be used. As shown in FIGS. 10-12, a normally curved Belleville washer 28 may be used. The spring-like characteristics of the Belleville washer 28 provide a tighter, more secure connection between the first and second conduit assemblies. The washer also provides a smooth surface upon which the head member 63 of the first fastener 61 may rotate.

A boot assembly 91 is disposed on the first contact plate 41, as shown in FIGS. 11 and 12. The boot assembly 91 includes a boot sleeve 92 and a boot cap 93 connected to the sleeve by a strap 96. The boot sleeve 92 covers the first contact plate 41 and the protective cover 23 of the first conduit assembly 21. An opening 97 in the sleeve 92 is aligned with the aperture 43 in the first contact plate to allow the first fastener 61 to be inserted in the aperture after the sleeve has been positioned on the first conduit assembly 21 and first contact plate 41.

The boot cap 93 is adapted to cover the head member 63 of the first fastener 61. The boot cap 93 has a circumferential groove 94 on an inner surface 95 of wall 99. The head member 63 of the first fastener 61 has a circumferential recess 62 on the outer surface 60. The recess 62 is adapted to receive the circumferential groove 94 of the boot cap 93. The opening 97 in the boot assembly 91 is adapted to receive the first and second fasteners therethrough. The boot assembly 91 is made of an elastomeric material, such as polyvinylchloride (PVC), thermal plastic rubber (TPR) or silicone.

Assembly and Disassembly

The first and second conduit assemblies 21 and 31 are shown electrically and mechanically connected in FIG. 1. The first and second conduit assemblies 21 and 31 are shown just prior to being electrically and mechanically connected in FIG. 3.

The first plurality of cables 24-26 of the first conduit assembly 21 are terminated in any suitable, conventional manner. The ends of the terminated cables are then electrically and mechanically connected to a first contact plate 41 in any suitable, conventional manner, such as by soldering or welding. The connection between the cables 24-26 and the first contact plate 41 may then be covered with a protective cover 23 to preserve the connection and prevent the connection from degrading over time due to exposure to detrimental conditions, as shown in FIGS. 1-3 and 10-12.

The second plurality of cables 34-36 of the second conduit assembly 31 are terminated in any suitable, conventional manner. The terminated cable ends are then electrically and mechanically connected to a second contact plate 51 in any suitable, conventional manner, such as by soldering or welding. The connection between the cables 34-36 and the second contact plate 51 may then be covered with a protective cover 33 to preserve the connection and prevent the connection from degrading over time due to exposure to detrimental conditions, as shown in FIGS. 1 and 3.

The first fastener 61 is inserted in the aperture 43 in the first contact plate 41 of the first conduit assembly 21, as shown in FIGS. 4, and 6-9. The distal end 66 of the first fastener 61 is then swaged radially outward into a substantially frustoconical configuration using a conventional swage block and/or other conventional swaging devices to bend and shape the distal end, preferably without heating the metal to prevent the first fastener 61 from being removed from the first contact plate 41, as shown in FIGS. 7-9. The first fastener 61 may be swaged directly to the first contact plate 41. Swaging the distal end 66 of the first fastener 61 reshapes the distal end of the first fastener 61 after it has been inserted in the aperture 43 of the first contact plate 41, thereby increasing the diameter of the body portion at the distal end. The larger diameter of the swaged distal end prevents the first fastener 61 from being removed from the first contact plate 41 because the diameter of the head member 63 and the diameter of the swaged distal end are larger than the diameter of the first contact plate aperture 43. As shown in FIGS. 8 and 9, the first contact plate aperture 43 may be counterbored (FIG. 8) or countersunk (FIG. 9) to facilitate swaging the distal end of the first fastener. The first fastener 61 is rotatable within the aperture 43, as well as being non-releasable.

Alternatively, a spacer 81 may be positioned adjacent the lower surface 44 of the first contact plate 41, as shown in FIGS. 1, 3, 4, 6 and 7. The opening 85 in the spacer 81 is aligned with the aperture 43 in the first contact plate 41 and receives the body portion 65 of the first fastener 61. The distal end 66 of the first fastener 61 is then swaged to prevent the first fastener 61 from being removed from the spacer 81 and the first contact plate 41, thereby also preventing the spacer from being removed, as shown in FIG. 7. The first fastener 61 is swaged directly to the spacer 81. The step 86 in the spacer opening 85 may be of any configuration to facilitate swaging the distal end 66 of the first fastener 61, such as the angled step shown in FIG. 4. The first fastener 61 is rotatable within the aperture 43 of the first contact plate 41 and the spacer opening 85, as well as being non-releasable.

The second fastener 71 is secured to the second contact plate, as shown in FIG. 3. The second fastener 71 is then inserted in the internally threaded passageway 67 of the first fastener 61. Since the first fastener 61 is rotatable, rotating the first fastener draws the second fastener 71 up into the first fastener. Preferably, a wrench or other tool is used to rotate the head member 63 of the first fastener 61. The first fastener 61 is rotated until the upper surface 53 of the second contact plate 51 is adjacent the lower surface 44 of the first contact plate 41.

If a spacer 81 is used, the first fastener 61 is rotated until the spacer 81 is sandwiched between the first and second contact plates, as shown in FIG. 3, i.e., the upper surface 82 of the spacer 81 is adjacent the lower surface 44 of the first contact plate and the lower surface 84 of the spacer is adjacent the upper surface 53 of the second contact plate 51. By forming the connection by simply rotating the first fastener 61, the first and second cables and contact plates do not need to be moved or rotated to complete the connection. The first and second conduit assemblies are thereby electrically and mechanically connected. The electrical path continues from the first cables 24-26, through the first contact plate 41, through the first fastener 61, through the second contact plate 41 and into the second cables 34-36.

A washer may be positioned between the lower surface 59 of the head member 63 of the first fastener 61 and the upper surface 42 of the first contact plate 41. The washer may be a flat washer 27 (FIGS. 8 and 9), a Belleville washer (FIGS. 10-12), or any other suitable washer. The washer provides a smooth contact surface for the head member 63 to facilitate rotation of the first fastener to draw the second fastener 71 into the first fastener to complete the connection between the first and second conduit assemblies. The washer may be used with the spacer 81.

A protective boot assembly 91 may be positioned on the first contact plate 41, as shown in FIGS. 11 and 12. The boot sleeve 92 covers the first contact plate 41 and a portion of the protective cover 23 of the first conduit assembly 21. The opening 97 passes through the sleeve 92 and is aligned with the aperture 43 in the first contact plate to allow the first fastener 61 to be inserted in the aperture after the sleeve has been positioned on the first conduit assembly 21 and first contact plate 41. Once the first fastener 61 has been swaged, the boot cap 93 is positioned on the head member 63 of the first fastener 61. The circumferential groove 94 on the inner surface 95 of the boot cap 93 is received by the circumferential recess 62 on the outer surface 60 of the head member 63. An outer surface 98 of the boot cap is partially received within the opening 97 in the sleeve 92, as shown in FIG. 12, and the lower end 90 of the boot cap is adjacent the washer 28, or upper surface 44 of the first contact plate 41 if a washer is not used. The opening 97 in the boot sleeve 92 receives the second fastener 71 therethrough to complete the connection between the first and second conduit assemblies.

In another embodiment, a first fastener 161 is used having an externally threaded body portion 165, as shown in FIGS. 13-15. The first fastener 161 is disposed in the aperture 43 in the first conductive contact plate 41. The lip 125 of the first fastener 161 is swaged to rotatably and non-releasably secure the first fastener to the first conductive contact plate 41. As shown in FIG. 13, the external threads 166 of the first fastener 161 are adapted to be received by an aperture 153 in a second conductive contact plate 151 in which the aperture 153 is internally threaded 155. Since the first fastener 161 is rotatable, rotating the first fastener draws the first and second conductive contact plates together as the threaded portion 166 of the first fastener is threaded through the threads 155 of the aperture 153 in the second contact plate 151. Preferably, a wrench or other tool is used to rotate the head member 163 of the first fastener 161. The first fastener 161 is rotated until the upper surface 152 of the second contact plate 151 is adjacent the lower surface 144 of the first contact plate 41.

Alternatively, a second fastener 161 may be disposed in the aperture 153, as shown in FIG. 14. Preferably, the second fastener 161 is press fit in the aperture 153. The second fastener 161 has an internally threaded passageway 173 adapted to receive the external threads 166 of the first fastener 161. Since the first fastener 161 is rotatable within the aperture 43 of the first contact plate 41, rotating the first fastener draws the first and second conductive contact plates together as the threaded portion 166 of the first fastener is threaded through the threaded passageway 173 of the second fastener 171. Preferably, a wrench or other tool is used to rotate the head member 163 of the first fastener 161. The first fastener 161 is rotated until the upper surface 152 of the second contact plate 151 is adjacent the lower surface 144 of the first contact plate 41.

While advantageous embodiments have been chosen to illustrate the invention, it will be understood by those skilled in the art that various changes and modifications may be made therein without departing from the scope of the invention as defined in the appended claims.

What is claimed is:

1. An electrical connector, comprising:

a first electrical conduit assembly having a first conductive contact and an aperture in said first conductive contact;

a first fastener rotatably received in said aperture, said first fastener having a head member and a body portion, a threaded passageway extending from said head member to a distal end of said body portion, said distal end of said body portion being radially outwardly swaged into a substantially frustoconical configuration to prevent said first fastener from being accidentally removed from said aperture;

a second electrical conduit assembly having a second conductive contact; and a second fastener extending outwardly from said second conductive contact and adapted to be threadably received by said passageway of said first fastener.

2. An electrical connector according to claim 1, wherein a washer is disposed between said first conductive contact and said head member of said first fastener.

3. An electrical connector according to claim 2, wherein said washer is selected from the group consisting of flat washers and Belleville washers.

4. An electrical connector according to claim 1, wherein said aperture is countersunk to facilitate swaging said first fastener to said first conductive contact.

5. An electrical connector according to claim 1, wherein a spacer having a first opening therethrough is disposed on said first fastener proximal said distal end.

6. An electrical connector according to claim 5, wherein said first opening is countersunk to facilitate swaging said first fastener to said spacer.

7. An electrical connector according to claim 5, wherein said spacer is made of brass.

8. An electrical connector according to claim 1, wherein a boot assembly is disposed on said first conductive contact.

9. An electrical connector according to claim 8, wherein said boot assembly has a boot cap adapted to cover said head member of said first fastener.

10. An electrical connector according to claim 9, wherein said boot cap has a circumferential groove on an inner wall thereof, and said head member of said first fastener has a circumferential recess adapted to receive said circumferential groove of said boot cap.

11. An electrical connector according to claim 8, wherein said boot assembly has a second opening therethrough adapted to receive said first and second fasteners therethrough.

12. An electrical connector according to claim 8, wherein said boot assembly is made of an elastomeric material.

13. An electrical connector according to claim 12, wherein said elastomeric material is selected from the group consisting of PVC, TPR and silicone.

14. An electrical connector according to claim 1, wherein said first fastener is made of brass.

15. An electrical connector according to claim 1, wherein said head member is larger than said aperture.

16. A terminal for an electrical conduit, comprising:

a conductive contact having an aperture therein;

a conductive securing member having a support section and a first locking section;

said conductive securing member having a threaded through passageway adapted to threadably receive another terminal;

said securing member support section being rotatably received in said aperture in said conductive contact, said locking section being radially outwardly swaged into a substantially frustoconical configuration after said support section is received in said aperture; and a second locking section associated with said conductive contact to resist removal of said conductive securing member from said conductive contact by engaging said first locking section on said securing member.

17. A terminal for an electrical conduit according to claim 16, wherein said first locking section is located at the distal end of said conductive securing member.

18. A terminal for an electrical conduit according to claim 16, wherein said conductive securing member support section is larger than said aperture.

19. A terminal for an electrical conduit according to claim 16, wherein a washer is disposed between said conductive contact and said conductive securing member support section.

20. A terminal for an electrical conduit according to claim 19, wherein said washer is selected from the group consisting of flat washers and Belleville washers.

21. A terminal for an electrical conduit according to claim 16, wherein said conductive securing member is made of brass.

22. A terminal for an electrical conduit according to claim 16, wherein a boot assembly is disposed on said conductive contact.

23. A terminal for an electrical conduit according to claim 22, wherein said boot assembly has a boot cap adapted to cover said support section of said conductive securing member.

24. A terminal for an electrical conduit according to claim 23, wherein said boot cap has a circumferential groove on an inner wall thereof, and said support section of said conductive securing member has a circumferential recess adapted to receive said circumferential groove of said groove cap.

25. A terminal for an electrical conduit according to claim 22, wherein said boot assembly has an opening therethrough adapted to receive said conductive securing member.

26. An electrical connector, comprising:

a first electrical conduit assembly having a first conductive contact and a first aperture in said first conductive contact;

a first fastener rotatably received in said first aperture, said first fastener having a head member and a body portion, a part of said body portion being radially outwardly swaged into a substantially frustoconical configuration to prevent said first fastener from being accidentally removed from said first aperture, said first fastener having a threaded passageway extending from said head member to a distal end of said body portion; and a second electrical conduit assembly having a second conductive contact, said second conductive conduct being adapted to threadably engage said first fastener.

27. An electrical connector according to claim 26, wherein a second fastener extends outwardly from said second conductive contact, and is adapted to be received by said first fastener threaded passageway.

28. An electrical connector according to claim 26, wherein a portion of said body portion of said first fastener is threaded.

* * * * *